US005651734A

United States Patent [19]

Morris

[11] Patent Number: 5,651,734

[45] Date of Patent: Jul. 29, 1997

[54] RIDGE CAP ROOF VENTILATOR APPLIED IN ROLL FORM AND METHOD OF USE

[75] Inventor: Richard J. Morris, Prior Lake, Minn.

[73] Assignee: Liberty Diversified Industries, Inc., Brooklyn Park, Minn.

[21] Appl. No.: 570,656

[22] Filed: Dec. 11, 1995

[51] Int. Cl.[6] ..... F24F 7/02

[52] U.S. Cl. ..... 454/365; 52/199

[58] Field of Search ..... 454/365; 52/57, 52/199

[56] References Cited

U.S. PATENT DOCUMENTS 4,803,813 2/1989 Fiterman ..... 454/365 X 5,002,816 3/1991 Hofmann et al. ..... 454/365 X

*Primary Examiner*—Harold Joyce

*Attorney, Agent, or Firm*—Larkin, Hoffman, Daly & Lindgren, Ltd

[57] ABSTRACT

A rolled ridge vent comprising a longitudinal blank of corrugated plastic sheet material having an undivided top panel extending its length, and segmented portions extending laterally from each side of the top panel scored to be folded into opposing pairs of vent parts. Adjacent segmented portions may be cut entirely through or perforated for manual separation. The entire blank is spiral rolled in the longitudinal direction. The ridge vent is installed by placing the roll on the peak of the roof with the free end extending over the top and oriented away from the direction of installation. The blank is unrolled to expose at least one pair of segmented portions, which are then folded under the top panel to form the vent parts and fastened to the roof. This process is repeated until the desired length is installed. Foam end caps and air deflectors optionally may be installed.

20 Claims, 3 Drawing Sheets

RIDGE CAP ROOF VENTILATOR APPLIED IN ROLL FORM AND METHOD OF USE

FIELD OF THE INVENTION

The present invention relates to ridge cap roof ventilators folded from a blank of corrugated plastic sheet material having two vent parts and an intermediate top panel, and particularly to such a roof ventilator that may be applied from a spiral roll of sheet material.

BACKGROUND OF THE INVENTION

The art is relatively well defined relating to ridge cap roof ventilators fabricated from corrugated plastic sheet material and folded to form two vent parts disposed on opposing sides of an opening in a roof peak and an intermediate top panel.

U.S. Pat. No. 4,803,813 to Fiterman and U.S. Pat. Nos. 5,04,041 and 5,331,783 to Kasner describe various methods for scoring, folding, and routing blanks of corrugated plastic sheet material to form the roof vents, as well as their method of installation and use.

These folded roof ventilators and similar designs were traditionally made and sold in lengths of approximately four feet. However, a hinged double-length roof vent was developed as disclosed in U.S. Pat. No. 5,304,095 to Morris which enhanced the shipping and installation of such roof vents.

In comparison, other types of highly flexible roof covering products such as shingles, tar paper, and some roof ventilation products fabricated from open celled foam or other pliable materials are distributed in roll form, which permits longer lengths of product to be installed in one operation without transitions, and eliminates some potentially undesirable features such as seams or gaps.

BRIEF SUMMARY OF THE INVENTION

It is therefore the goal of the present invention to provide a ridge cap roof ventilator of the type folded from a scored blank of corrugated plastic sheet material having a substantial length that may be distributed and installed in roll form.

Briefly described, the rolled roof vent of this invention comprises a "continuous" longitudinal blank of corrugated plastic sheet material having an undivided top panel extending its entire length, with segmented portions extending laterally from both sides of the top panel that are scored to be folded into the opposing pairs of vent parts. Adjacent segmented portions may be cut entirely through, or may be perforated for manual separation during installation. The entire blank is then spiral rolled in the longitudinal direction.

The ridge vent is installed by placing the roll on the peak of the roof covering the pre-cut ventilation opening, with the free end of the roll disposed extending over the top of the roll and oriented away from the direction of installation. A length of the blank is unrolled until at least one pair of segmented portions are completely exposed. Those exposed segmented portions are then folded under the top panel to form the opposing vent parts, and the free end is fastened to the roof in a conventional manner. The blank is further unrolled to expose another pair of segmented portions which are similarly folded into vent parts and secured to the roof. The process continues until the desired length has been installed. Foam end caps and air deflectors may optionally be installed if desired.

DETAILED DESCRIPTION OF THE PREFERRED EMBODIMENTS

The method and apparatus of this invention are illustrated in FIGS. 1–7 and referenced generally therein by the numeral 10.

The prior art disclosures relating to the fabrication and structure of three-ply corrugated plastic sheet material having a convoluted intermediate ply, the nick-scoring and cut-scoring procedures utilized to construct folded roof ventilators, and the various other features, optional components, improvements, and methods of fabrication and use associated with these products are incorporated into this specification by reference as though fully recited herein, including but not limited to the disclosures contained in U.S. Pat. No. 4,803,813 to Fiterman, U.S. Pat. Nos. 5,04,041 and 5,331,783 to Kasner, U.S. Pat. No. 5,304,095 to Morris, and U.S. patent application Ser. Nos. 08/127,005 filed on Sep. 24, 1993 relating to an Adjustable Air Deflector for a Roof Ventilator and 08/126,307 filed on Sep. 24, 1993 relating to an End Closure or Intermediate Support for a Roof Ventilator and Method of Making Same.

Figure 1:
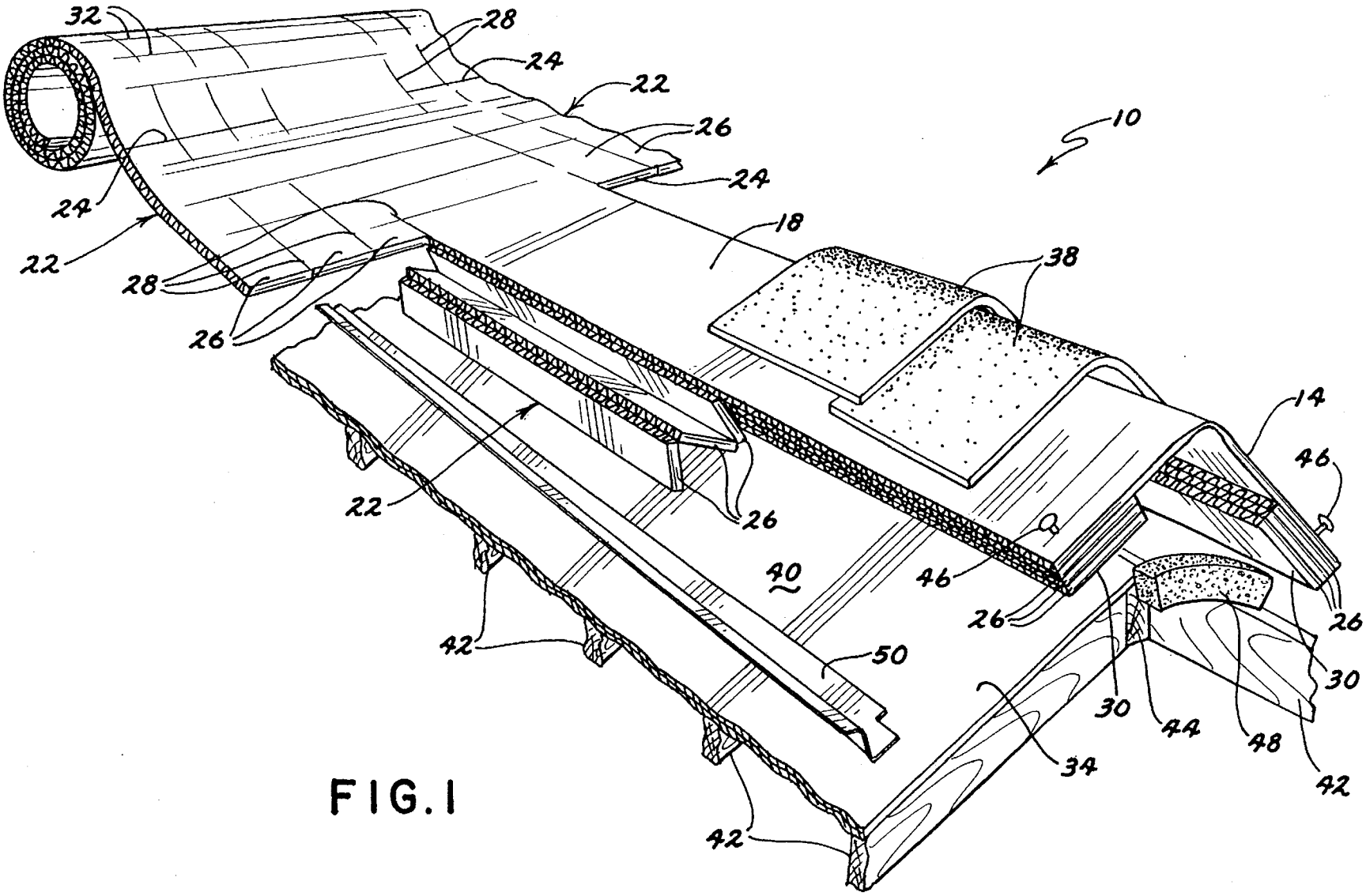
FIG. 1 is a partially exploded perspective view of the rolled ridge vent of this invention being installed on the peak of a roof.
Figure 3:
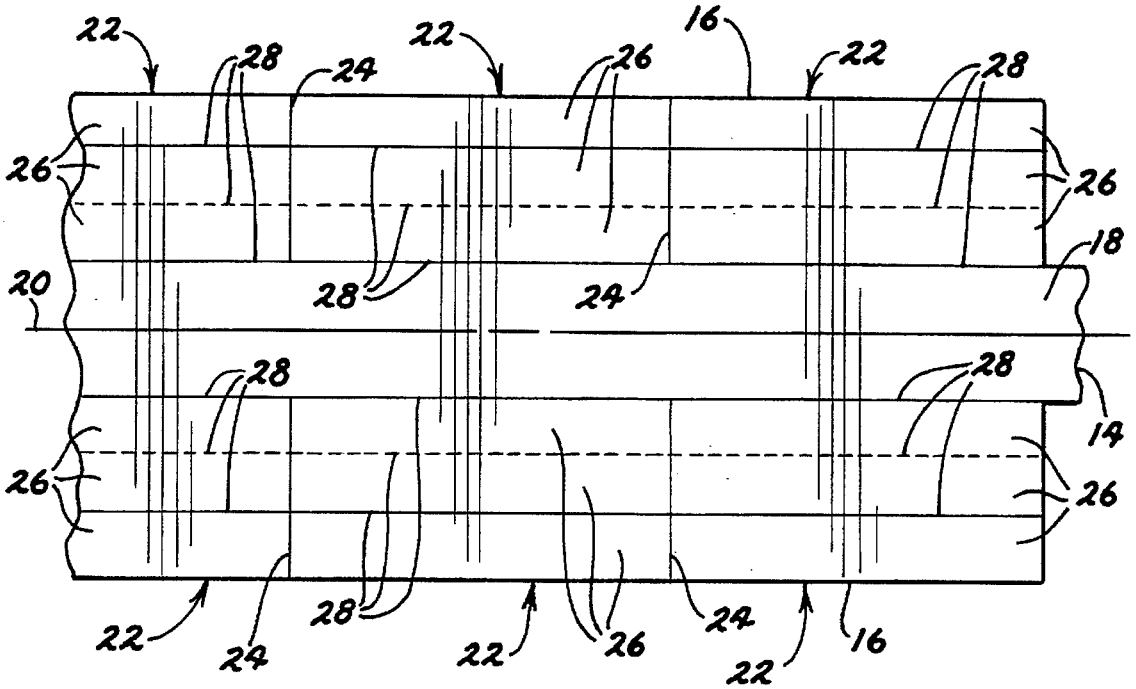
FIG. 3 is a top plan view of a portion of the "continuous" longitudinal blank used to fabricate the rolled ridge vent of FIG. 1.

Referring particularly to FIGS. 1 and 3, the rolled ridge vent 10 of this invention is shown in the process of installation, and as a generally "continuous" longitudinal blank 12. The blank 12 has finite length, but is considered "continuous" in the sense that it is a repeating pattern that may have any desired length that is practical and commercially suitable for its intended use in the manner described herein.

A broken away portion of the blank 12 is shown in FIG. 3, the blank 12 having a free end 14 and two opposing side edges 16. The blank 12 defines a top panel 18 that extends in an uninterrupted manner the length of the blank 12 generally parallel with and bisected by a longitudinal centerline 20.

Extending from and hingedly connected to each of the two opposing side edges 16 are a plurality of segmented portions 22, with six such entire segmented portions 22 being shown in FIG. 3. Each adjacent pair of segmented portions 22 are separated from one another by a common cut line 24 that extends generally perpendicular to the longitudinal centerline 20, the cut lines 24 either extending entirely through the blank 12 or being substantially perforated to facilitate manual separation of the adjacent segmented portions 22 during installation.

Each segmented portion 22 is further divided into a plurality of interconnected flaps or panels 26 that are connected to one another and to the top panel 18 along hinged fold lines 28 of either the cut-scored or nick-scored type. The panels 26 of the segments portions 22 may each have a generally uniform width to form vent parts 30 that have a generally uniform rectangular cross section as shown, or may have alternately have staggered widths to form vent parts 30 having tapered or angled cross sections.

Referring again to FIGS. 1 and 3, it may be seen that the corrugated plastic sheet material defines a grain 32 extending parallel to the orientation of the convolutions of the intermediate ply of the blank 12, thus being oriented generally perpendicular to the longitudinal centerline 20 such that the scored fold lines 28 cut through the blank and form a multiplicity of parallel air passages that extend and provide fluid communication between the interior and exterior regions of each vent part 30, as is well known in the art.

After being cut and scored to form the segmented portions 22 and panels 26, the blank 12 is then rolled into a tight spiral as shown in FIGS. 1–4 and secured in that spiral configuration for storage, distribution, sale, and transportation to an installation site. It may be appreciated that the rolling process is preferably automated and conducted immediately subsequent to the cutting and scoring processes to maintain the blank 12 in a generally planar configuration for rolling, and that each blank 12 may be manufactured in predetermined lengths or cut to the desired length from a continuous web of corrugated plastic sheet material as it is being fabricated, cut, and scored.

Referring to FIGS. 1 and 4–7, the method of installing the rolled ridge vent 10 is shown. The installation site provides a house or other building structure having a generally peaked roof 34 defining a ridge opening 36 extending therethrough for ventilation. Portion of the roof may be covered with shingles 38, and the roof 34 will usually include planar underlayment 40 supported by joists 42 and a central beam 44.

Figure 2A:
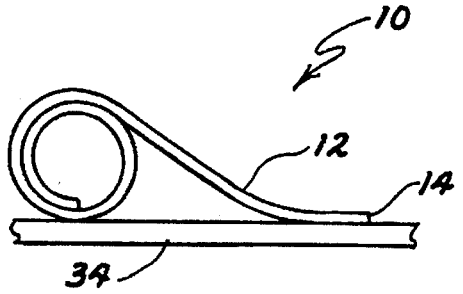
FIG. 2*a* is a diagrammatic side elevation view showing the free end of a rolled ridge vent extending over the top of the roll, with the direction of installation being right to left and the spiral having a counter-clockwise orientation.
Figure 2B:
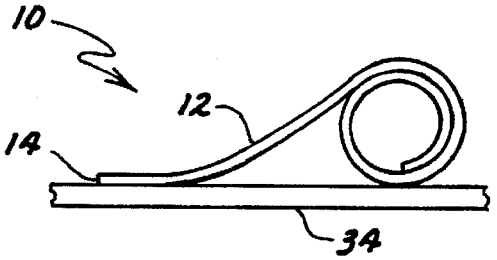
FIG. 2*b* is a diagrammatic side elevation view showing the free end of a rolled ridge vent extending over the top of the roll, with the direction of installation being left to right and the spiral having a clockwise orientation.

The rolled ridge vent 10 is placed on top of the peak of the roof 34 with the free end 14 extending across the top of the roll and oriented facing the end of the roof 34, or conversely facing away from the direction of installation. Referring to FIGS. 2*a* and 2*b*, when viewed from the side elevation, the rolled ridge vent 10 will have a free end 14 extending over the top of the roll 10 when the direction of installation is from right to left and the spiral of the roll 10 has a counter-clockwise orientation, as shown in FIG. 2*a*. Conversely, when viewed from the side elevation, the rolled ridge vent 10 will have a free end 14 extending over the top of the roll 10 when the direction of installation is from left to fight when the spiral of the roll 10 has a clockwise orientation, as shown in FIG. 2*b*. In this manner, the rolled ridge vent 10 may be handled and installed by one individual without the roll 10 inadvertently unrolling as the first or subsequent segmented portions 22 are being folded and secured to the roof.

Figure 4:
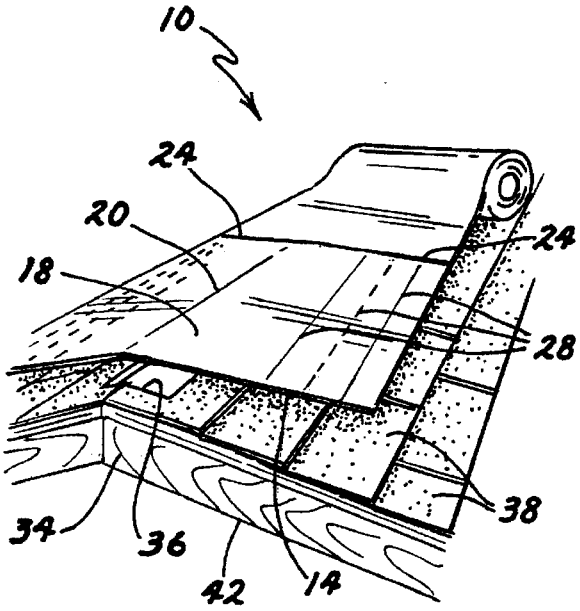
FIG. 4 is a broken away perspective view showing the free end of the rolled ridge vent being unrolled to initiate the installation process.
Figure 5:
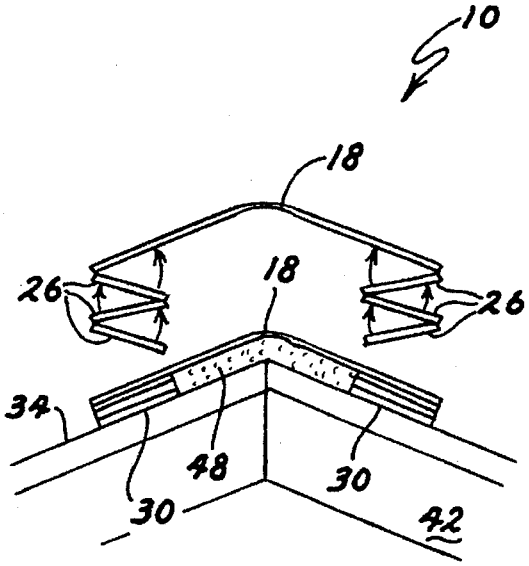
FIG. 5 is a diagrammatic end elevation view showing the exposed segmented portions being folded under the top panel to form the opposing vent parts, with the top panel being initially flexed to form the arcuate curve to bring the vent parts into confronting contact with the roof.
Figure 6:
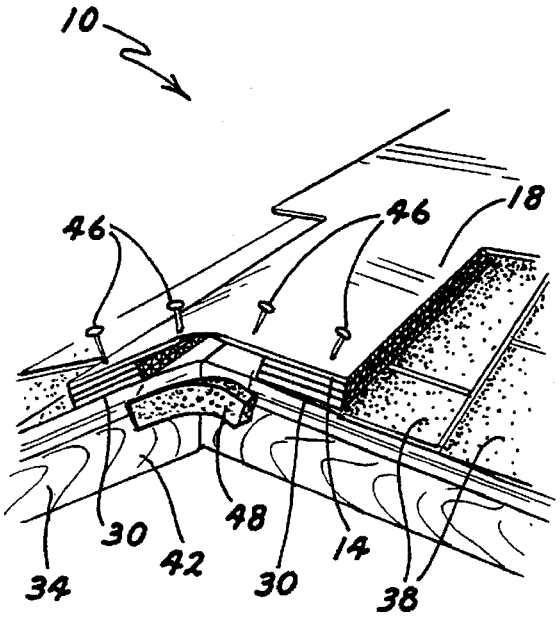
FIG. 6 is a broken away and partially exploded perspective view of the exposed segmented portions adjacent the free end of the rolled ridge vent folded completely under the top panel to form the opposing vent parts and the top panel flexed to bring the vent parts into confronting contact with the roof, further with a foam end cap positioned for insertion into the open end of the ridge vent and fasteners for securing the opposing vent parts and top panel to the roof.

The free end 14 of the rolled ridge vent 10 is positioned adjacent the edge of the roof 34 or at another desired starting point with the roll disposed above the roof opening 36, and the blank 12 is then unrolled a short distance along the peak of the roof 34 to feed or expose at least one corresponding pair of the segmented portions 22, as shown in FIG. 4. The exposed segmented portions are either separate from the sequentially adjacent segmented portions 22 along cut line 24, or the installer manually separates the segmented portions using the perforations corresponding to cut line 24. The exposed segmented portions 22 are then folded downwardly and inwardly under the top panel 18 as shown in FIGS. 1 and 5, with the panels 26 being accordion folded into close confronting planar contact with one another to form the stacked vent parts 30. The free end 14 of the blank 12 is then fastened to the roof 34 in a conventional manner using fasteners 46 such as nails or staples as shown in FIGS. 1 and 6, and an intermediate portion of the first segmented portion 22 may similarly be secured to the roof 34. It may be readily appreciated that although the blank 12 is very flexible along the grain 32, it may be advantageous not to secure an entire segmented portion 22 to the roof 34 until the roll 10 has been sufficiently unrolled to expose the next subsequent segmented portion 22 to permit the panels 26 of the subsequent segmented portion 22 to be folded downwardly and under the top panel 18 and held in place while securing the first or previous segmented portion 22 to the roof 34 is completed.

Figure 7:
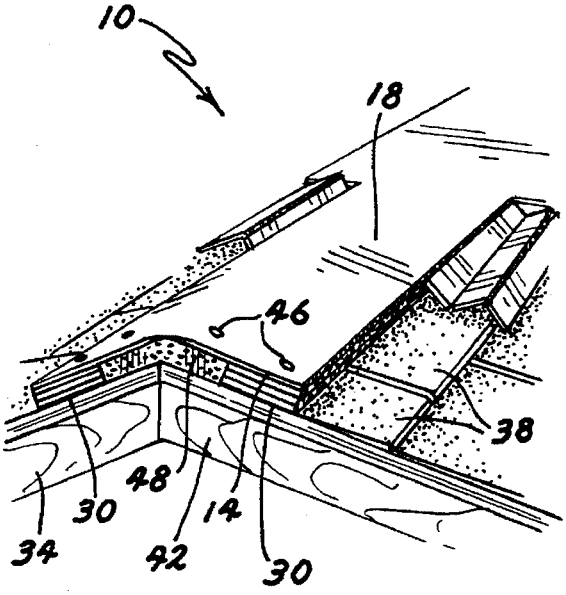
FIG. 7 is a broken away perspective view of the exposed segmented portions adjacent the free end of the rolled ridge vent and the foam end cap completely installed and secured to the roof, with the next sequential pair of segmented portions exposed and being folded under the top panel to form opposing vent parts.

The blank 12 is then further unrolled to expose another subsequent pair of segmented portions 22 which are similarly folded into vent parts 30 and secured to the roof 34 as shown in FIGS. 1 and 7. This process is repeated until the desired length of the blank 12 or rolled roof vent 10 has been unrolled, folded, and secured to the roof 34. Any excess length of the rolled roof vent 10 may be but away and discarded or used on a separate section of the roof 34.

Foam end caps 48 or intermediate supports and adjustable air deflectors 50 may optionally be installed in a conventional manner if desired, either during or subsequent to the installation of the rolled roof vent 10, as shown in FIGS. 1, 6, and 7.

Although the present invention has thus been described in detail with reference to the preferred embodiments for practicing that invention, other embodiments, modifications, alterations, or substitutions deemed within the spirit and scope of the present invention may suggest themselves to those skilled in the art depending upon the particular applications involved.

It is therefore intended that the present invention be limited only by the properly attributable scope of the attached claims below.

What is claimed is:

1. A method for installing a ridge vent onto a roof defining an opening, said ridge vent having a top panel and a pair of opposing vent parts disposed on each side of said opening, said top panel and said vent parts being fabricated from a corrugated material defining a multiplicity of air passages, said method comprising the steps of:

providing a blank in a spiral rolled configuration, said blank having a length and being cut and scored to form said top panel extending generally along said length and a plurality of segmented portions hingedly connected to said top panel, each of said plurality of segmented portions defining one or more panels;

positioning said blank in said spiral rolled configuration on the roof proximate to the opening;

unrolling at least a portion of said blank so as to expose at least a first opposing pair of said segmented portions disposed on opposing sides of said top panel;

folding said first opposing pair of said segmented portions to define a first portion of the pair of vent parts disposed on opposing sides of the opening;

unrolling a further portion of said blank so as to expose at least a subsequent opposing pair of said segmented portions disposed on opposing sides of said top panel; and folding said subsequent opposing pair of said segmented portions to define a second portion of the pair of vent parts disposed on opposing sides of the opening.

2. The method of claim 1 further comprising the step of:

securing the first opposing pair of the segmented portions defining the first portion of the pair of vent parts to the roof.

3. The method of claim 3 wherein the step of securing the first opposing pair of the segmented portions defining the first portion of the pair of vent parts to the roof is performed prior to the step of folding the subsequent opposing pair of the segmented portions to define the second portion of the pair of vent parts.

4. The method of claim 1 wherein the ridge vent is installed in a direction proceeding from right to left when viewed from a given perspective, and wherein the rolled spiral configuration of the blank has a clockwise orientation when viewed from said perspective.

5. The method of claim 4 wherein the blank has a free end and the rolled spiral configuration has a top, said free end extending over said top and generally away from the direction of installation.

6. The method of claim 1 wherein the ridge vent is installed in a direction proceeding from left to fight when viewed from a given perspective, and wherein the rolled spiral configuration of the blank has a counter-clockwise orientation when viewed from said perspective.

7. The method of claim 4 wherein the blank has a free end and the rolled spiral configuration has a top, said free end extending over said top and generally away from the direction of installation.

8. The method of claim 1 wherein the number of the one or more panels in each of the plurality of segmented portions is three.

9. The method of claim 8 wherein each of the one or more panels in each of the plurality segmented portions has a width, said widths being generally equal to one another.

10. The method of claim 8 wherein each of the one or more panels in each of the plurality segmented portions is hingedly connected to either another of the one or more panels or the top panel.

11. The method of claim 10 wherein the one or more panels in each of the plurality segmented portions are accordion folded into close confronting parallel planar alignment with one another and with the top panel.

12. The method of claim 1 wherein adjacent ones of the plurality of segmented portions are separated from one another by cut lines extending through the blank.

13. The method of claim 1 further comprising the step off repeating the steps of unrolling the blank to expose a next subsequent opposing pair of the segmented portions, and folding said next subsequent opposing pair of the segmented portions to define a next portion of the pair of vent parts disposed on opposing sides of the opening, until the entire blank is installed on the roof.

14. A method for installing a roofing covering onto a roof, said roof covering having a top panel and a pair of opposing parts, said method comprising the steps of:

providing a blank in a spiral rolled configuration, said blank having a length and being cut and scored to form said top panel extending generally along said length and a plurality of segmented portions hingedly connected to said top panel, each of said plurality of segmented portions defining one or more panels;

positioning said blank in said spiral rolled configuration on the roof;

unrolling at least a portion of said blank so as to expose at least a first opposing pair of said segmented portions;

folding said first opposing pair of said segmented portions to define a first portion of the pair of opposing parts;

unrolling a further portion of said blank so as to expose at least a subsequent opposing pair of said segmented portions; and folding said subsequent opposing pair of said segmented portions to define a second portion of the pair of opposing parts.

15. The method of claim 14 further comprising the step of:

repeating the steps of unrolling the blank to expose a next subsequent opposing pair of the segmented portions, and folding said next subsequent opposing pair of the segmented portions to define a next portion of the pair of opposing parts, until the entire blank is installed.

16. A blank for a ridge vent to be installed installation on a roof, said roof defining an opening, said blank being fabricated from a corrugated material defining a multiplicity of air passages, said blank comprising:

a top panel having a length, a free end, and a pair of opposing side edges; and a plurality of segmented portions hingedly connected to and extending outwardly from each of said pair of opposing side edges of said top panel and disposed along the length thereof, each of said plurality of segmented portions being separated from an adjacent one of said plurality of segmented portions along a common cut line such that each of said plurality of segmented portions may be folded relative to said top panel independently of said adjacent one of said plurality of segmented portions.

17. The blank of claim 16 wherein the blank is rolled into a generally spiral configuration.

18. The blank of claim 16 wherein each of the plurality of segment portions further comprises:

a plurality of panels, each of said plurality of panels being hingedly connected to another one another of said plurality of panels or to the top panel or both.

19. The blank of claim 18 wherein each of the plurality of panels are connected along score lines extending partially through the corrugated material.

20. The blank of claim 19 wherein the corrugated material has a grain extending generally parallel with the multiplicity of air passages, and the score lines extend generally perpendicular to said gain.

* * * * *

UNITED STATES PATENT AND TRADEMARK OFFICE

CERTIFICATE OF CORRECTION

PATENT NO. : 5,651,734
DATED : July 29, 1997
INVENTOR(S) : Morris

It is certified that error appears in the above-identified patent and that said Letters Patent is hereby corrected as shown below:

Column 3, line 19, delete "segments" and insert --segmented--.

Column 3, line 22, after "may" delete "have".

Column 3, line 66, delete "fight" and insert --right--.

Column 5, line 21, delete "claim 3" and insert --claim 2--.

Column 5, line 37, delete "fight" and insert --right--.

Column 5, line 62, delete "off" and insert --of:--.

Column 5, line 63, beginning with the word "repeating", indent the entire paragraph.

Column 6, line 33, delete "installation".

UNITED STATES PATENT AND TRADEMARK OFFICE

CERTIFICATE OF CORRECTION

PATENT NO. : 5,651,734

DATED : July 29, 1997

INVENTOR(S) : Morris

It is certified that error appears in the above-identified patent and that said Letters Patent is hereby corrected as shown below:

Column 6, line 55, delete "one another".

Column 6, line 63, delete "gain" and insert "grain".

Signed and Sealed this

Seventeenth Day of February, 1998

*Attest:*

*Attesting Officer*

BRUCE LEHMAN

*Commissioner of Patents and Trademarks*